US010139152B2

(12) United States Patent
Gunduz et al.

(10) Patent No.: US 10,139,152 B2
(45) **Date of Patent: *Nov. 27, 2018**

(54) REFRIGERATOR COMPRISING A DRAWER

(71) Applicant: ARCELIK ANONIM SIRKETI, Istanbul (TR)

(72) Inventors: Nihat Gunduz, Istanbul (TR); Celal Vatansever, Istanbul (TR); Serdar Kocaturk, Istanbul (TR); Samet Akan, Istanbul (TR); Cumhur Ayvazoglu, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

This patent is subject to a terminal disclaimer.

(21) Appl. No.: 15/027,245

(22) PCT Filed: Oct. 1, 2014

(86) PCT No.: PCT/TR2014/000351

§ 371 (c)(1),
(2) Date: Apr. 4, 2016

(87) PCT Pub. No.: WO2015/050513

PCT Pub. Date: Apr. 9, 2015

(65) Prior Publication Data

US 2016/0245582 A1 Aug. 25, 2016

(30) Foreign Application Priority Data

Oct. 3, 2013 (TR) ..... a 2013/11634

(51) Int. Cl.
*F25D 25/02* (2006.01)
*F25D 17/06* (2006.01)

(52) U.S. Cl.
CPC ..... *F25D 25/025* (2013.01); *F25D 17/062* (2013.01); *F25D 2317/061* (2013.01)

(58) Field of Classification Search
CPC ..... F25D 2307/00; F25D 2317/06; F25D 2317/061; F25D 2317/063;
(Continued)

(56) References Cited

U.S. PATENT DOCUMENTS 2,107,076 A * 2/1938 Mason ..... F25D 11/02 312/236
4,358,935 A * 11/1982 Losert ..... A23B 7/148 62/188
(Continued)

FOREIGN PATENT DOCUMENTS

CA 2026078 A1 4/1991
CA 2113860 A1 9/1994
(Continued)

OTHER PUBLICATIONS

International search report for PCT application No. PCT/TR2014/000351 and references contained therein are considered to be closest material prior art and any additional references cited in the application merely define the general state of the art and/or are duplicative.
(Continued)

*Primary Examiner* — Andrew M Roersma
(74) *Attorney, Agent, or Firm* — Kilpatrick Townsend & Stockton LLP

(57) ABSTRACT

The present invention relates to a refrigerator (1) comprising a body (2) wherein foodstuffs and beverages are placed; a protector plate (3) placed into the body (2); at least one drawer (4) that is placed under the protector plate (3), wherein fruits and vegetables are placed; a separator plate (6) that is disposed over the protector plate (3) and that has more than one hole (5) enabling the air delivered to the protector plate (3) to at least partially reach the drawer (4); a ceiling (7) that is situated above the separator plate (6) so that there is a distance between the separator plate (6) and
(Continued)

Figure 1:
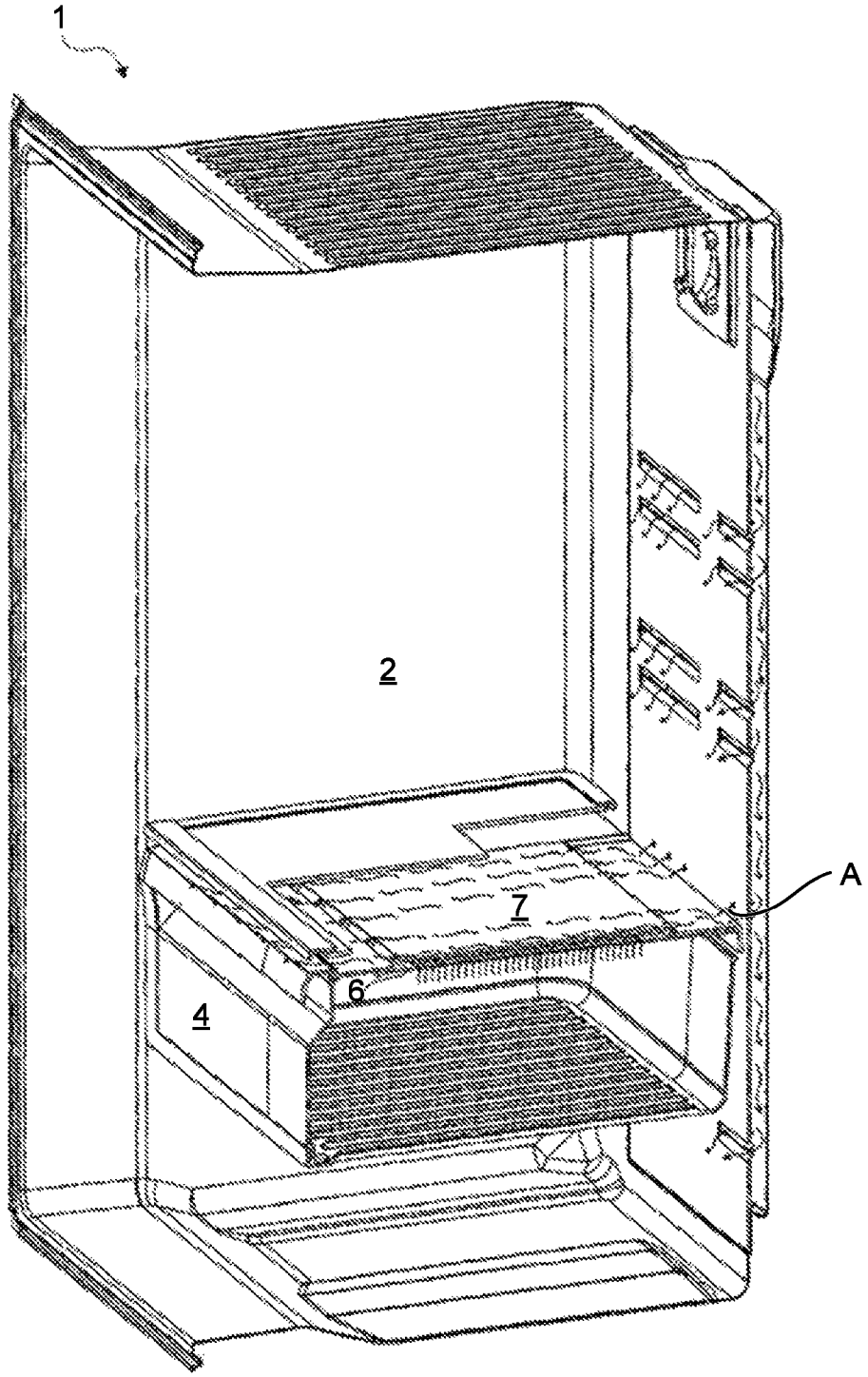

the ceiling (7); and at least one air blowing opening (A) enabling cold air to be blown to the protector plate (3).

11 Claims, 4 Drawing Sheets

(58) Field of Classification Search
CPC ..... F25D 2317/066; F25D 2317/0665; F25D 2317/0413; F25D 2317/04131; F25D 17/042; F25D 17/045; F25D 17/062; F25D 17/065; F25D 25/025; F25D 2317/00
See application file for complete search history.

(56) References Cited

U.S. PATENT DOCUMENTS

| | | | | |
|---|---|---|---|---|
| 4,488,412 | A | 12/1984 | Weaver et al. | |
| 4,788,832 | A | 12/1988 | Aoki et al. | |
| 4,850,206 | A | 7/1989 | Larsen | |
| 5,004,305 | A | 4/1991 | Montuoro et al. | |
| 5,346,299 | A | 9/1994 | Werkmeister et al. | |
| 5,357,769 | A | 10/1994 | Crabtree et al. | |
| 5,694,788 | A | 12/1997 | Shin | |
| 5,720,185 | A * | 2/1998 | Lee | A47F 3/0408 62/329 |
| 5,735,589 | A | 4/1998 | Herrmann et al. | |
| 5,769,517 | A * | 6/1998 | Carde | E05B 65/0014 292/238 |
| 5,918,480 | A * | 7/1999 | Nagata | A23B 7/0425 215/310 |
| 6,012,400 | A | 1/2000 | Sosso | |
| 6,463,752 | B2 * | 10/2002 | Mandel | F25D 17/042 62/382 |
| 6,637,235 | B2 * | 10/2003 | Sakamoto | F25D 17/065 62/441 |
| 6,659,293 | B1 | 12/2003 | Smith | |
| 7,108,341 | B2 | 9/2006 | Myers et al. | |
| 7,363,773 | B2 | 4/2008 | Lee et al. | |
| 8,015,839 | B2 * | 9/2011 | Kang | F25D 17/065 62/407 |
| 8,047,623 | B2 | 11/2011 | Kang et al. | |
| 8,419,080 | B2 * | 4/2013 | Levine | A47B 95/00 292/303 |
| 2002/0149304 | A1 | 10/2002 | Bienick | |
| 2003/0010056 | A1 | 1/2003 | Sakamoto et al. | |
| 2003/0151340 | A1 | 8/2003 | Mathur et al. | |
| 2006/0254481 | A1 | 11/2006 | Lee et al. | |
| 2008/0000260 | A1 | 1/2008 | Lim et al. | |
| 2008/0134712 | A1 | 6/2008 | Civanelli | |
| 2008/0202146 | A1 | 8/2008 | Lim et al. | |
| 2008/0265733 | A1 | 10/2008 | Hue et al. | |
| 2008/0282714 | A1 * | 11/2008 | Cushman | F25D 17/065 62/152 |
| 2008/0303401 | A1 | 12/2008 | Ji | |
| 2009/0139259 | A1 | 6/2009 | Kang | |
| 2009/0199587 | A1 | 8/2009 | Matthews et al. | |
| 2009/0212505 | A1 | 8/2009 | McMillin et al. | |
| 2010/0001625 | A1 | 1/2010 | Eckartsberg et al. | |
| 2010/0319374 | A1 * | 12/2010 | Ihle | F25D 17/045 62/176.1 |
| 2010/0326941 | A1 | 12/2010 | Rosenblum | |
| 2011/0017890 | A1 | 1/2011 | Ala | |
| 2011/0031862 | A1 | 2/2011 | Leconte et al. | |
| 2011/0148267 | A1 * | 6/2011 | McDaniel | A47B 96/021 312/404 |
| 2012/0062093 | A1 | 3/2012 | Lee et al. | |
| 2012/0228786 | A1 | 9/2012 | Wang et al. | |
| 2013/0200772 | A1 | 8/2013 | Mahat et al. | |

FOREIGN PATENT DOCUMENTS

| | | | | |
|---|---|---|---|---|
| CA | 2453680 | A1 | 6/2005 | |
| CA | 2453683 | A1 | 6/2005 | |
| CN | 1138374 | A | 12/1996 | |
| CN | 101071031 | A | 11/2007 | |
| CN | 103047806 | A | 4/2013 | |
| CN | 202928273 | U | 5/2013 | |
| DE | 19524255 | A1 | 2/1996 | |
| DE | 19755289 | A1 | 6/1999 | |
| DE | 102008059216 | A1 | 6/2010 | |
| DE | 102008054870 | A1 | 7/2010 | |
| EP | 0020198 | B1 | 1/1983 | |
| EP | 0248370 | A2 * | 12/1987 | F25D 17/065 |
| EP | 0648990 | A1 * | 4/1995 | F25D 25/021 |
| EP | 0685695 | B1 | 10/1997 | |
| EP | 1154211 | A1 | 11/2001 | |
| EP | 2324306 | A1 | 5/2011 | |
| FR | 2650561 | A1 | 2/1991 | |
| JP | S 63113886 | U * | 7/1988 | F25D 25/00 |
| JP | S6488087 | A | 4/1989 | |
| JP | H02136676 | A | 5/1990 | |
| JP | H02136677 | A | 5/1990 | |
| JP | H02150682 | A | 6/1990 | |
| JP | H03110375 | A | 5/1991 | |
| JP | H03213988 | A | 9/1991 | |
| JP | H043876 | A | 1/1992 | |
| JP | H0473577 | A | 3/1992 | |
| JP | H04302980 | A | 10/1992 | |
| JP | H07318219 | A | 12/1995 | |
| JP | H08128780 | A | 5/1996 | |
| JP | H0937899 | A | 2/1997 | |
| JP | H11118347 | A | 4/1999 | |
| JP | H11304354 | A | 11/1999 | |
| JP | 2002267350 | A | 9/2002 | |
| JP | 2003294357 | A | 10/2003 | |
| JP | 2004116844 | A | 4/2004 | |
| KR | 20040068387 | A | 7/2004 | |
| KR | 20090006373 | A | 1/2009 | |
| TR | 200001422 | T2 | 9/2000 | |
| WO | WO 0075584 | A1 * | 12/2000 | F25D 25/02 |
| WO | 2007/062911 | A1 | 6/2007 | |
| WO | 2007/129170 | A2 | 11/2007 | |
| WO | 2008/077757 | A2 | 7/2008 | |
| WO | WO 2009083388 | A2 * | 7/2009 | F25D 17/062 |
| WO | 2009/127550 | A2 | 10/2009 | |
| WO | WO 2010029041 | A1 * | 3/2010 | F25D 17/062 |
| WO | 2012/052453 | A2 | 4/2012 | |
| WO | 2012/130578 | A1 | 10/2012 | |
| WO | 2013/082845 | A1 | 6/2013 | |
| WO | WO 2014180700 | A1 * | 11/2014 | F25D 17/042 |
| WO | WO 2016050449 | A1 * | 4/2016 | F25D 17/042 |

OTHER PUBLICATIONS

Written opinion of the international searching authority for PCT application No. PCT/TR2014/000351and references contained therein are considered to be closest material prior art and any additional references cited in the application merely define the general state of the art and/or are duplicative.

* cited by examiner

REFRIGERATOR COMPRISING A DRAWER

The present invention relates to a refrigerator comprising a protector plate that provides ease of utilization.

Refrigerators comprise a fresh food compartment wherein foods and beverages are stored, a freezer compartment that enables foods to be stored by being frozen, and a crisper that is disposed in the fresh food compartment, wherein foods such as vegetables and fruits are stored. In order to prevent the foods placed in the crisper from dehydrating by sweating, the air flow between the protector plate and the fresh food compartment has to remain at a limited level. In the state of the art, humidity control is provided by passing air controllably through the holes by the protector plate having the perforated separator plate. However, the said holes may be clogged due to dirt like residues of various fruits, vegetables etc. during use, which decreases the protector plate performance and moreover causes an unpleasant appearance. Therefore, especially the separator plate part has to be cleaned by the user.

In the state of the art United States of America Patent Application No. US2008134712A1, a drawer is disclosed, having a perforated covering and wherein humidity is controlled.

The aim of the present invention is the realization of a refrigerator comprising a protector plate that can be easily cleaned and that is provided with ease of utilization.

The refrigerator realized in order to attain the aim of the present invention, explicated in the first claim and the respective claims thereof, comprises a separator plate that can be attached to/detached from the protector plate and that has more than one hole enabling some of the air delivered to the protector plate to reach the drawer, a ceiling that at least partially covers the separator plate such that a gap remains between the separator plate and the ceiling and that is produced to be integrated with the protector plate, and at least one air blowing opening (A) that enables cold air to be blown to the protector plate.

In an embodiment of the present invention, the separator plate is dismounted from over the protector plate when pulled by the user towards himself/herself and is mounted to the protector plate when pulled by the user in the reverse direction.

In an embodiment of the present invention, the separator plate is quadrilateral. The protector plate comprises two claws that extend downwards from the protector plate, that faces each other and that enables the separator plate to be held from the right and left sides.

In an embodiment of the present invention, the refrigerator comprises a retainer that is disposed on the protector plate and at the side of the protector plate close to the user and that extends from the protector plate towards the drawer, and an opening that is arranged on the separator plate and at the side of the separator plate close to the user, wherein the retainer partially remains when the separator plate is mounted to the protector plate and against the periphery of which the retainer bears.

In an embodiment of the present invention, the protector plate comprises an extension that extends to the lower side of the protector plate that remains at the rear side of the protector plate, that faces the front side of the protector plate and that enables the rear side of the separator plate to be held.

By means of the present invention, a protector plate is realized, the production cost of which is decreased, that is improved in terms of hygienic utilization conditions and that provides ease of utilization.

A refrigerator realized in order to attain the aim of the present invention is illustrated in the attached figures, where:

FIG. 1—is the schematic view of a refrigerator and a drawer therein.

Figure 2:
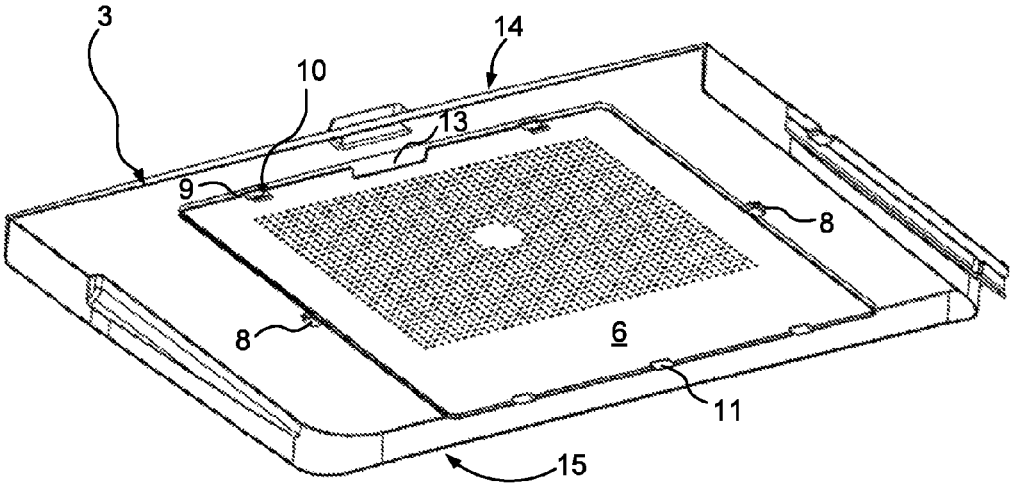

FIG. 2—is the perspective view of the protector plate and the separator plate when mounted to one another in an embodiment of the present invention.

Figure 3:
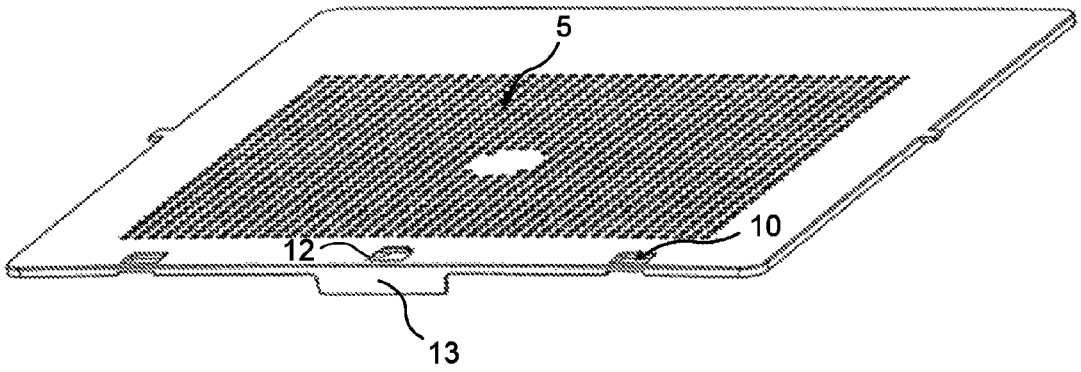

FIG. 3—is the perspective view of the separator plate in an embodiment of the present invention.

Figure 4:
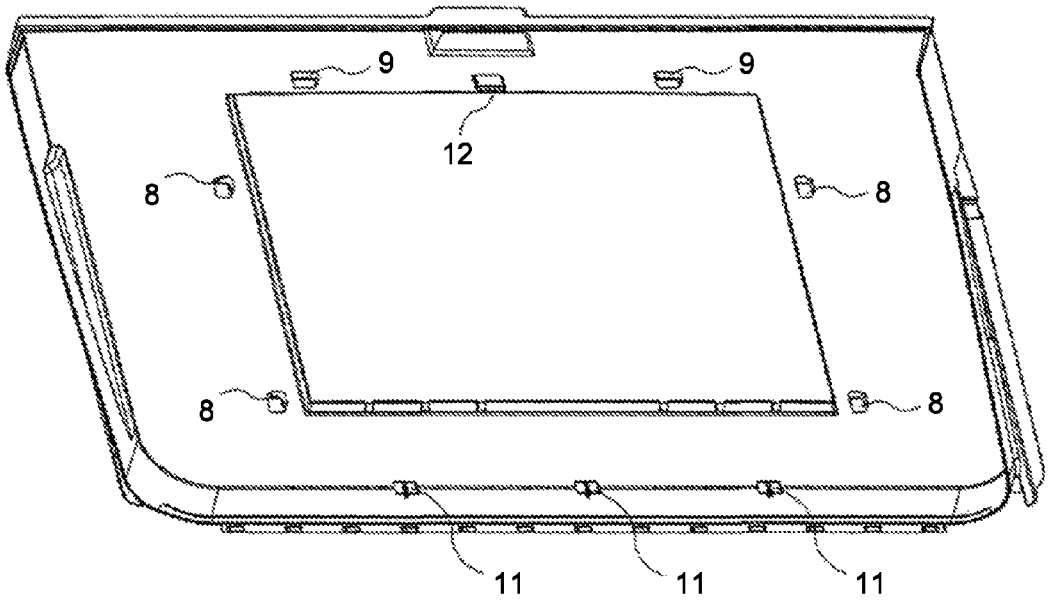

FIG. 4—is the perspective view of the protector plate in an embodiment of the present invention.

The elements illustrated in the figures are numbered as follows:

1. Refrigerator
2. Body
3. Protector plate
4. Drawer
5. Hole
6. Separator plate
7. Ceiling
8. Claw
9. Retainer
10. Opening
11. Extension
12. Stopper
13. Handle The refrigerator (1) comprises a body (2) wherein foodstuffs and beverages are placed; a protector plate (3) placed into the body (2); at least one drawer (4) that is placed under the protector plate (3), wherein fruits and vegetables are placed; a separator plate (6) that is disposed over the protector plate (3) and that has more than one hole (5) enabling the air delivered to the protector plate (3) to at least partially reach the drawer (4); a ceiling (7) that is situated above the separator plate (6) so that there is a distance between the separator plate (6) and the ceiling (7); and at least one air blowing opening (A) enabling cold air to be blown to the protector plate (3) (FIG. 1, FIG. 2, FIG. 3).

The refrigerator (1) of the present invention furthermore comprises the ceiling (7) produced as a single piece with the protector plate (3) and the separator plate (6) mounted detachably under the ceiling (7).

The air blown from the air blowing opening (A) enters partially between the ceiling (7) and the separator plate (6) and the air that enters between the ceiling (7) and the separator plate (6) leaves partially from the outlets on the ceiling (7) and is partially delivered to the drawer (4) under the separator plate (6) from the holes (5) on the separator plate (6). Humidity balance is maintained inside the drawer (4) by means of the separator plate (6) structure and the controlled air flow. That the separator plate (6) is easily detachable enables the user to easily clean the separator plate (6) when desired. Dirt is mostly seen on the surface of the separator plate (6). That the ceiling (7) is integrated with the protector plate (3) provides ease of production. The ceiling (7) extends upwards from over the protector plate (3) with a chamfered structure and is situated on the protector plate (3) so that a distance remains between the separator plate (6) and the ceiling (7). The separator plate (6) almost entirely covers the lower part of the ceiling (7). The separator plate (6) is mounted to the protector plate (3) snap-fittingly. Thus, air is prevented from leaking from the sides of the separator plate (6).

In an embodiment of the present invention, the separator plate (6) can be dismounted from the protector plate (3) by sliding and mounted on the protector plate (3) by sliding. The user can dismount the separator plate (6) by pulling toward himself/herself and mount by pushing in the reverse direction. Thus, the separator plate (6) can be cleaned by being separated from the protector plate (3) in a practical manner.

In an embodiment of the present invention, the refrigerator (1) comprises two claws (8) that are disposed on the protector plate (3), that extend downwards from the protector plate (3), being opposite to one another, each one holding one side of the separator plate (6) and enabling the separator plate (6) disposed therebetween to stay connected to the protector plate (3). The claws (8) hold the separator plate (6) from right and left sides.

In an embodiment of the present invention, the refrigerator (1) comprises a retainer (9) that is disposed on the protector plate (3) and that extends downwards from the protector plate (3), and an opening (10) that is arranged on the separator plate (6), wherein the retainer (9) remains when the separator plate (6) is placed into the protector plate (3) and wherein the separator plate (6) becomes attached to the protector plate (3) as the retainer (9) bears against its periphery.

In an embodiment of the present invention, the refrigerator (1) comprises an extension (11) that is situated on the protector plate (3) and at the rear side (15) of the protector plate (3), that extends to the front side (14) of the protector plate (3) and whereon the separator plate (6) is seated by sliding. The extension (11) grasps the side of the separator plate (6). The separator plate (6) partially inserted between the surface of the protector plate (3) and the extension (11) is thus kept at the rear side (15) of the protector plate (3).

In an embodiment of the present invention, the refrigerator (1) comprises the opening (10) arranged at the front side of the separator plate (6); the retainer (9) that is disposed at the front side of the protector plate (3) and that contacts the periphery of the said opening (10) when the separator plate (6) is placed into the protector plate (3); two claws (8) that are disposed on the protector plate (3), one holding the left side of the separator plate (6) and the other holding the right side of the separator plate (6); and the extension (11) that holds the separator plate (6) from the rear side, that extends towards the lower side of the protector plate (3), remaining at the rear side of the protector plate (3) and facing the front side of the protector plate (3). The separator plate (6) is placed on the claws (8) and the extension (11) by being slid and afterwards the opening (10) is seated on the retainer (9). Thus, the separator plate (6) is kept mounted to the protector plate (3).

In an embodiment of the present invention, the refrigerator (1) comprises a stopper (12) that is disposed on the separator plate (6), that extends above the separator plate (6) and that remains between the separator plate (6) and the ceiling (7) when the separator plate (6) is placed onto the protector plate (3). The user feels the contact of the stopper (12) to the periphery of the ceiling (7) while pulling the separator plate (6) for dismounting. The user must exert a force enabling the stopper (12) to slide on the periphery of the ceiling (7) when the separator plate (6) is desired to be dismounted from the protector plate (3).

In an embodiment of the present invention, the separator plate (6) is disposed at the center of the drawer (4). The separator plate (6) has a size that can be washed in a dishwasher. The center region of the protector plate (3) is the area where the condensation and dirt are mostly observed on the surface of the protector plate (3). Therefore, the separator plate (6) and the ceiling (7) structure is provided only at the center region in order to decrease production costs. The structure of the separator plate (6) and the ceiling (7) has a flat plate form that extends up to the walls of the refrigerator (1). The protector plate (3) completely surrounds the walls of the refrigerator (1).

In an embodiment of the present invention, the protector plate (3) comprises a handle (13) that is disposed near the front side of the separator plate (6) and that extends downward from the separator plate (6). The handle (13) is disposed at the front side of the separator plate (6), namely the side close to the user. Thus, the user can easily dislodge the separator plate (6) from the protector plate (3) by grasping the handle (13).

By means of the refrigerator (1) of the present invention, decrease in production costs is provided by producing the ceiling (7) integrated with the protector plate (3) and the separator plate (6), that is situated under the ceiling (7) at the region of the drawer (4) that becomes dirty most intensively, is enabled to be detachable.

The invention claimed is:

1. A refrigerator comprising:

a body wherein foodstuffs and beverages are placed;

a protector plate placed into the body, the protector plate having a front side, a rear side, a left side and a right side;

at least one drawer that is placed under the protector plate, wherein fruits and vegetables are placed;

a separator plate that is disposed over the protector plate and that has more than one hole enabling air delivered to the protector plate to at least partially reach the drawer;

a pair of claws extending downwards from the protector plate, disposed on the left side and the right side of the protector plate to grasp a left side and a right side of the separator plate, respectively;

a retainer disposed on the front side of the protector plate extending downward from the protector plate, the retainer retaining a front side of the separator plate;

an extension disposed at the rear side of the protector plate to grasp a rear side of the separator plate that is removably seated between a bottom surface of the protector plate and the extension at the rear side, the pair of claws on the left side and the right side;

a ceiling integrated with the protector plate and that is situated above the separator plate so that there is a distance between the separator plate and the ceiling; and at least one air blowing opening directing cold air to enter between the ceiling and the separator plate and to be partially delivered to the drawer under the separator plate from the holes on the separator plate, characterized by the ceiling produced as a single piece with the protector plate and by the separator plate mounted detachably under the ceiling.

2. A refrigerator as in claim 1, characterized by the separator plate that is dismounted from the protector plate by sliding and mounted on the protector plate by sliding.

3. A refrigerator as in claim 2, characterized by an opening that is arranged on the separator plate, wherein the separator plate becomes attached to the protector plate as the retainer goes through the opening and bears against a periphery of the opening.

4. A refrigerator as in claim 2, characterized by a stopper that is disposed on the separator plate, that extends above the separator plate and that remains between the separator plate and the ceiling when the separator plate is placed onto the protector plate.

5. A refrigerator as in claim 2, characterized by the separator plate that is centered above the drawer.

6. A refrigerator as in claim 2, characterized by a handle that is disposed near the front side of the separator plate and that extends downward from the separator plate.

7. A refrigerator as in claim 1, characterized by an opening that is arranged on the separator plate, wherein the separator plate becomes attached to the protector plate as the retainer goes through the opening and bears against a periphery of the opening.

8. A refrigerator as in claim 1, characterized by a stopper that is disposed on the separator plate, that extends above the separator plate and that remains between the separator plate and the ceiling when the separator plate is placed onto the protector plate.

9. A refrigerator as in claim 1, characterized by the separator plate that is centered above the drawer.

10. A refrigerator as in claim 1, characterized by a handle that is disposed near the front side of the separator plate and that extends downward from the separator plate.

11. A refrigerator as in claim 1, wherein the separator plate substantially covers a lower part of the ceiling to prevent the cold air from leaking from sides of the separator plate.

* * * * *